United States Patent [19]

Dworak

[11] 4,038,000

[45] July 26, 1977

[54] GEAR MACHINE WITH BEARING COOLING AND LUBRICATION

[75] Inventor: Wilhelm Dworak, Stuttgart, Germany

[73] Assignee: Robert Bosch G.m.b.H., Stuttgart, Germany

[21] Appl. No.: 567,113

[22] Filed: Apr. 10, 1975

[30] Foreign Application Priority Data

May 4, 1974 Germany ..... 2421599

[51] Int. Cl.[2] ..... F01C 21/04; F03C 3/00; F01C 1/18

[52] U.S. Cl. ..... 418/102; 418/131; 418/206

[58] Field of Search ..... 418/102, 86, 206, 131, 418/132, 15, 73

[56] References Cited

U.S. PATENT DOCUMENTS

| | | | |
|---|---|---|---|
| 1,927,749 | 9/1933 | Kimmig | 418/102 |
| 2,460,649 | 2/1949 | Muller | 418/86 |
| 2,655,108 | 10/1953 | Osborne | 418/206 |
| 2,974,605 | 3/1961 | Murray | 418/102 |
| 2,986,096 | 5/1961 | Booth et al. | 418/102 |
| 3,447,472 | 6/1969 | Hodges et al. | 418/102 |
| 3,478,694 | 11/1969 | Morando | 418/206 |
| 3,528,756 | 9/1970 | Norlin et al. | 418/102 |

FOREIGN PATENT DOCUMENTS

| | | | |
|---|---|---|---|
| 887,878 | 11/1943 | France | 418/206 |
| 735,766 | 4/1943 | Germany | 418/206 |
| 441,214 | 6/1924 | Germany | 418/206 |
| 1,528,965 | 10/1969 | Germany | 418/206 |
| 1,182,608 | 2/1970 | United Kingdom | 418/102 |

*Primary Examiner*—John J. Vrablik
*Attorney, Agent, or Firm*—Michael J. Striker

[57] ABSTRACT

A gear machine, such as a gear pump or gear motor, has a housing in a chamber of which there are journalled two gears which mesh with one another. The shafts of the gears are journalled for rotation in bearing sleeves. The housing has an intake for fluid at low pressure and an outlet for fluid at high pressure. The gaps between the teeth of the gears which receive fluid at low pressure communicate with the intake exclusively by way of passages which extend in part along the sleeves and shafts, so that the entire quantity of incoming fluid is compelled to travel in these passages and to cool and lubricate the sleeves and shafts.

6 Claims, 5 Drawing Figures

GEAR MACHINE WITH BEARING COOLING AND LUBRICATION

BACKGROUND OF THE INVENTION

The present invention relates generally to a gear machine, and more particularly to a gear machine of the type that can act as a gear pump or a gear motor.

It is known to provide gear machines of this type with forced cooling and lubrication. For this purpose the prior art proposes to form the sleeves in which the shafts of the gears are journalled for rotation, with spiral grooves which communicate with the intake of the machine, so that as fluid travels to the gaps between the teeth of the gears to be conveyed by the gears, some of this fluid is branched off and travels through the spiral grooves in order to cool and lubricate the shafts and sleeves.

Another prior construction operates on the same principle, i.e. some of the incoming fluid is branched off to cool and lubricate the bearings and shafts. In that construction the passages through which this fluid travels are configurated differently from the construction mentioned above.

Both of these prior-art constructions, however, have the disadvantage that they are capable of utilizing only some of the incoming fluid, namely a very minor portion thereof, for purposes of cooling and lubrication. Because of this, these prior-art constructions do not offer particularly effective cooling and lubrication and are totally insufficient for use in high-performance machines where excellent lubrication and cooling is a necessity.

SUMMARY OF THE INVENTION

Accordingly, it is an object of this invention to overcome the disadvantages of the prior art.

More particularly, it is an object of this invention to provide an improved gear machine of the type in question, i.e. a gear pump or gear motor, which avoids the aforementioned disadvantages.

A more particular object of the invention is to provide such an improved gear machine which offers a particularly effective cooling and lubrication of the gear shafts and the journalling sleeves.

In keeping with these objects, and others which will become apparent hereafter, one feature of the invention resides in a gear machine, such as a gear pump or motor, which comprises a combination of a housing having wall means bounding a chamber and provided with an intake and an outlet fluid, a pair of meshing gears having respective shafts and being mounted in the chamber, bearing sleeves journalling the shafts for rotation, and passage means connecting the suction side of the gears only with the intake and extending in part along the sleeves and shafts, so that all of the incoming fluid is compelled to travel in the passage means to thereby cool and lubricate the sleeves and shafts.

This construction assures that the entire quantity of fluid which travels through the pump or motor must pass the shafts and journalling sleeves and thus serves to provide a particularly effective cooling and lubricating effect. Only afterwards, that is after it has performed the cooling and lubricating function, can it reach the teeth of the gears.

The novel features which are considered as characteristics for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
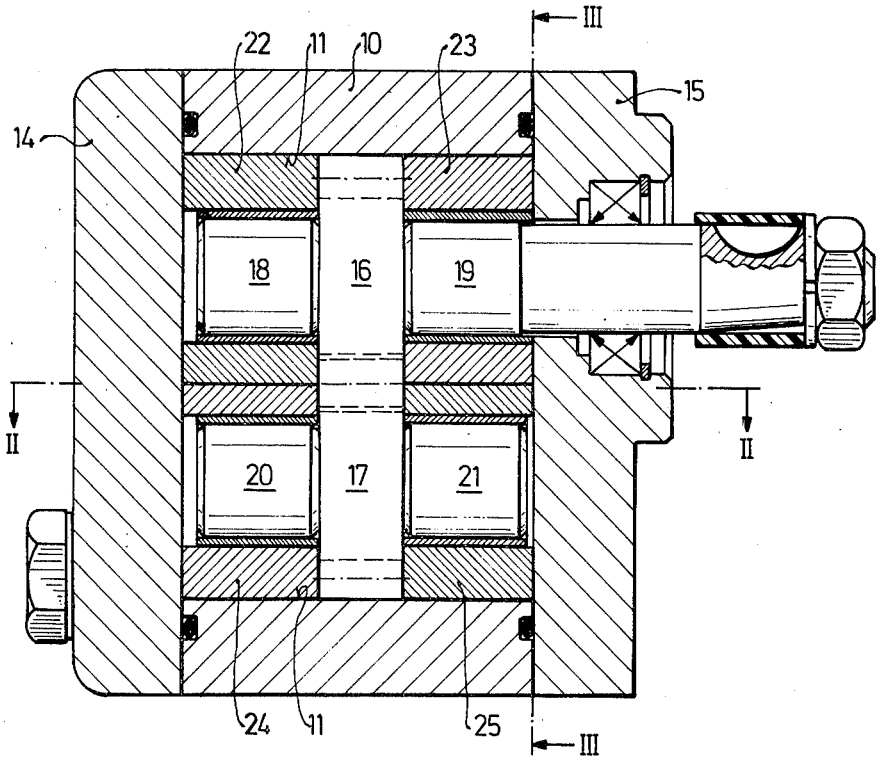
FIG. 1 is an axial section through a gear pump embodying the invention.
Figure 2:
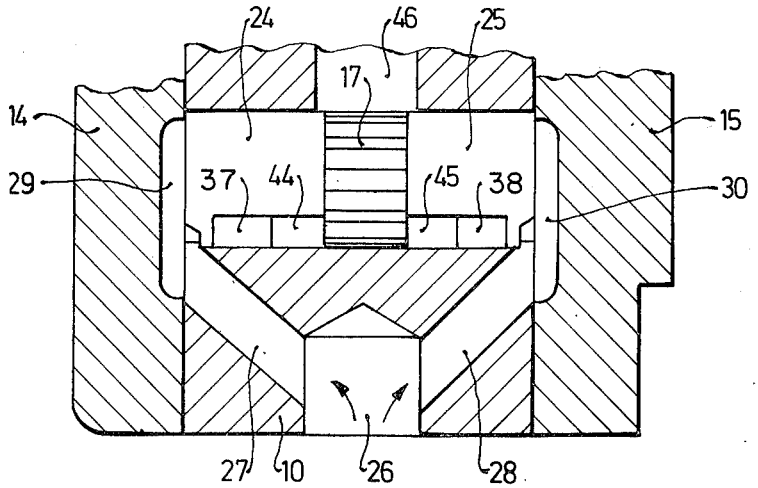
FIG. 2 is a section on line II—II of FIG. 1.

The invention has been illustrated by way of example as incorporated in the gear pump which is shown in several views in FIGS. 1–5. The gear pump has a central housing portion 10 formed with a chamber 11 which is produced by forming the housing portion 10 with two axially extending overlapping bores 12 and 13. The opposite axial ends of the housing portion 10 are closed by end covers 14 and 15, respectively.

A pair of gears 16, 17 is mounted in the chamber 11; the teeth of these gears mesh with one another so that the gears can perform a pumping function or act as a motor, in accordance with the operation of such gear machines which is well known in the art. The gears have stub shafts 18–19 and 20–21, respectively. They are journalled in journalling sleeve 22–23 and 24–25, respectively. These sleeves are arranged in the bores 12, 13 in such a manner that the sleeves 22 and 23 receive the stub shafts 18 and 19 and the sleeves 24 and 25 receive the stub shafts 20 and 21. The stub shaft 19 extends through the end cover 15 and serves to drive the machine, being driven from the exterior in a manner known in the art.

The central housing portion 10 is formed with a lateral bore 26 which is indirectly in communication with the suction side (i.e. the low-pressure side) of the pump. This bore 26 is a blind bore and two inclined bores 27 and 28 extend from it to the end covers 14 and 15, respectively. The bore 27 communicates with a shallow recess 29 formed in the end cover 14 which extends to the stub shafts adjacent that end cover. The outer contour of this recess is shown in broken lines in FIG. 3. Similarly, the bore 28 communicates with a shallow recess 30 which is formed in the end cover 15 and which is configurated in the same manner as the recess 29.

Each of the journalling sleeves 22, 23, 24 and 25 is formed at its inner circumference with a passage portion 31, 32, 33 or 34, respectively, which each extend over approximately half the circumference of the respective sleeve. These passage portions communicate directly with the recesses 29, 30, respectively and they face away from the suction side. The axial depth t of the passage portions 31–34 extends to the recesses 29, 30 respectively.

Figure 3:
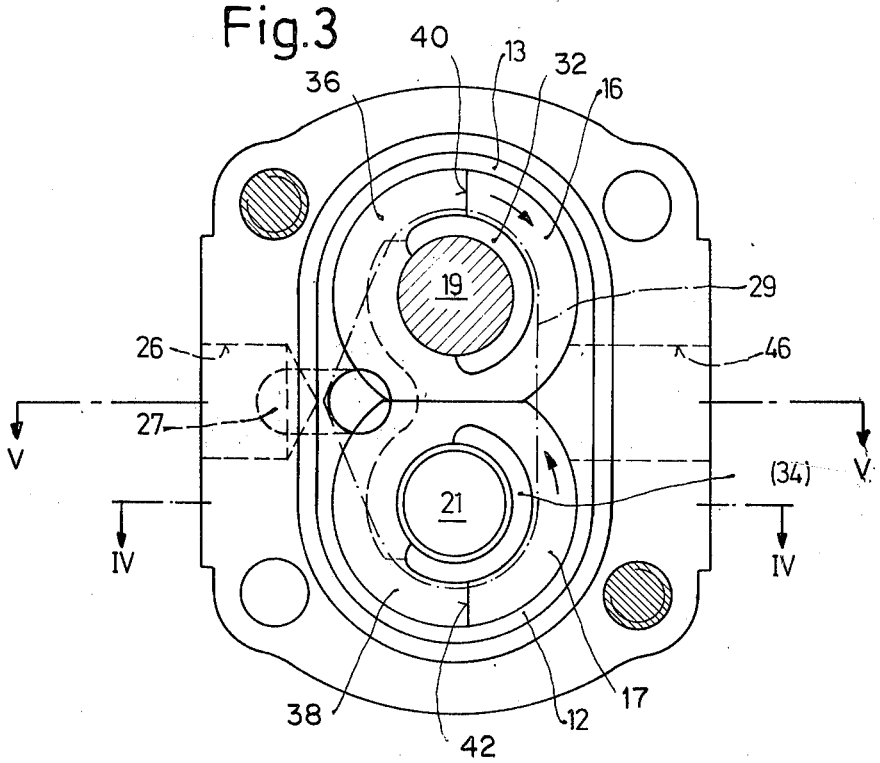
FIG. 3 is a section on line III—III of FIG. 1.
Figure 4:
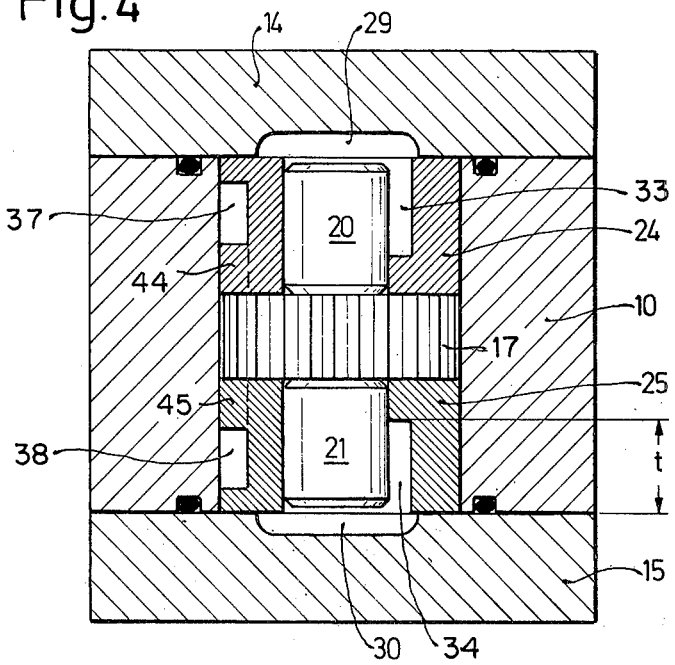
FIG. 4 is a section on line IV—IV of FIG. 3.
Figure 5:
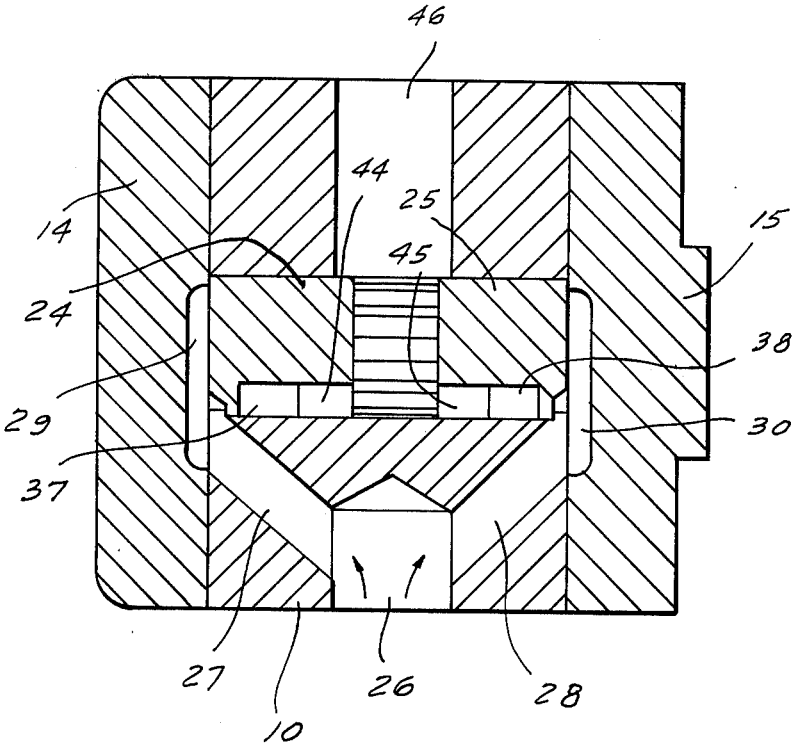
FIG. 5 is a section on line V—V of FIG. 3, taken slightly below the common contact plane of the bearing members.

Additional passage portions 35, 36, 37 and 38 are respectively formed at the external surface and approximately midway in the respective sleeves 22–25. Each of these passage portions 35–38 extends to the circumference of a shoulder 39–42, respectively; these shoulders coincide approximately with a line passing through the centers of the gears 16, 17. The passage portion 35–38 extend from the shoulders 39–42 in direction towards the suction side of the pump and are in communication with one another. The passage portions 35–38 also communicate with the recesses 29, 30, and the latter of course communicate with the bore 26. In FIG. 3, the exterior passage portions 35–38 are clearly shown to have a radially extending extension portion which establishes communication with the interior passage portions 31–34. It is believed to be evident therefore that the depth of each exterior passage portions 35–38 increases until, in the region where there is an overlap between the interior passage portion 31–34 and the exterior passage portion 35;14 38, the depth of each exterior passage portion is such that the latter actually communicates directly with the respective interior passage portion. Thus, the passage portions 31–38 and the recesses 29–30 communicate all with the bore 26, forming fluid passages for the travel of fluid therethrough. Grooves 44, 45, extend from the passage portions 35–38 to the end faces of the gears 16, 17 in the region where the teeth of the gears move out of engagement with one another, i.e. at the low pressure side of the pump.

In operation of the pump, and assuming that the gear 16 is driven in clockwise direction, the gaps between the gear teeth produce, as they open up due to the teeth moving out of mesh with one another, an underpressure in the region of the grooves 44, 45. As a result of this, the atmospheric pressure forces pressure fluid from the bore 26 via the bores 27, 28 into the recesses 29, 30 and from these into the passage portions 31–34 at the journalling sleeves. This pressure fluid then travels from the recesses 29, 30 also into the passage portions 35–38 at the outer circumference of the journalling sleeves and from there via the grooves 44 and 45 to the opening gaps between the teeth of the gears, that is to the suction side of the pump. This is the only way in which incoming pressure fluid can travel to the gears to be pumped by the same, so that the entire quantity of fluid travelling through the pump must necessarily travel through the passages which have been described above and in so doing will necessarily cool and lubricate the journalling sleeves and the stub shafts along which it flows. The journalling sleeves are intensively cooled and lubricated by the flow of the fluid through the passage portions 35–38.

With this measure the machine according to the present invention is provided with a cooling and lubricating circuit which is extraordinarily effective, and this assures that the temperature of the stub shafts and of the journalling sleeves is reliably maintained at a low level, which in turn provides for a significant increase in the effectiveness of the gear machine. The pressure fluid which has been pumped by the gears 16, 17 is subsequently supplied via the outlet 46 to a user (not illustrated).

It is self-evident that if the gear pump illustrated in FIGS. 1–5 is operated as a motor, then pressure fluid —which may of course be cooled— is supplied via the outlet 46 to the gears 16, 17. In this case, the roles of inlet port 26 and outlet portion 46 are reversed. Port 46 will now constitute the low pressure side so that the pressure fluid will now be supplied from this low pressure side to port 26. Port 26 will now constitute the high pressure side for the fluid.

It will be understood that each of the elements described above, or two or more together, may also find a useful application in other types of constructions differing from the types described above.

While the invention has been illustrated and described as embodied in a gear machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a gear machine, such as a gear pump or motor, a combination comprising a housing having an inner circumferential wall bounding a chamber; inlet and outlet ports in communication with said chamber for respectively admitting and discharging fluid relative thereto; gearing means mounted in said chamber and including a pair of meshing gears each having respective shafts at opposite axial sides of said gearing means; bearing sleeves journalling said shafts for rotation; wall means bounding said chamber at opposite ends thereof, said wall means being a pair of side walls each formed with a recess which overlies the respective shafts at each axial side of said gearing means; a pair of bores formed in said housing and extending from one of said ports to a respective one of said recesses at each axial side of said gearing means, said bores constituting the only source of communication with said one port and having a combined cross-sectional configuration such that all of the fluid at said one port communicates with said recesses; means for simultaneously cooling and lubricating all of the interior sleeve regions which surround said shafts, including interior passage portions formed in the internal surfaces of said sleeves, said interior passage portions communicating with said recesses and being operative for conveying all of the fluid from said one port along a part of the lengths of the respective shafts so as to cool and lubricate the latter; means for simultaneously cooling and lubricating all of the exterior sleeve regions which face said circumferential wall, including exterior passage portions formed in the external surfaces of said sleeves, said exterior passage portions communicating with said interior passage portions and being operative for conveying all of the fluid from the latter along a part of the lengths of the respective sleeves so as to cool and lubricate the latter; and passage means communicating said exterior passage portions with said chamber, whereby all of the fluid passing through the machine is employed in cooling and lubricating all of the sleeves and all of the shafts in a simultaneous and uniform manner.

2. A combination as defined in claim 1, wherein said exterior passage portions are formed substantially midway of the axial ends of the respective sleeve.

3. A combination as defined in claim 1, wherein said one port is an elongated bore having an axis of symmetry, and wherein said pair of bores are located on opposite sides of said axis and extend away from the latter such that each longitudinal axis of a respective one of said pair of bores is inclined relative to said axis of symmetry of said elongated bore.

4. A combination as defined in claim 1, wherein said passage means comprises grooves, and wherein said exterior passage portions extend over substantially half the periphery of the respective sleeves and communicate via said grooves with the gaps between the teeth of said gears at the suction side of the latter.

5. A combination as defined in claim 1, wherein said interior passage portions each extends over substantially half the periphery of the respective sleeves at a side thereof which faces away from said one port.

6. A combination as defined in claim 5, wherein said passage means comprises grooves, and wherein said exterior passage portions extend over substantially half the periphery of the respective sleeves and communicate via said grooves with the gaps between the teeth of said gears at the suction side of the latter.

* * * * *